US009193502B2

(12) United States Patent
Ishii et al.

(10) Patent No.: US 9,193,502 B2
(45) Date of Patent: Nov. 24, 2015

(54) PACKAGING MATERIAL AND PACKED PRODUCT IN WHICH VISCOUS PRODUCT IS PACKED BY PACKAGING MATERIAL

(71) Applicant: Morinaga Milk Industry Co., Ltd., Tokyo (JP)

(72) Inventors: Tomonori Ishii, Tokyo (JP); Taho Ohmura, Tokyo (JP); Nobuaki Shirashoji, Zama (JP); Tetsuo Nakai, Joso (JP); Kazutaka Makino, Yokohama (JP); Yukihiro Yamada, Zama (JP)

(73) Assignee: Morinaga Milk Industry Co., Ltd., Tokyo (JP)

( * ) Notice: Subject to any disclaimer, the term of this patent is extended or adjusted under 35 U.S.C. 154(b) by 54 days.

(21) Appl. No.: 14/021,486

(22) Filed: Sep. 9, 2013

(65) Prior Publication Data

US 2014/0008263 A1 Jan. 9, 2014

Related U.S. Application Data

(63) Continuation of application No. 13/131,517, filed as application No. PCT/JP2009/006528 on Dec. 2, 2009, now Pat. No. 8,556,105.

(30) Foreign Application Priority Data

Dec. 2, 2008 (JP) ..... 2008-307285

(51) Int. Cl.
*B65D 75/58* (2006.01)
*B65D 65/26* (2006.01)
(Continued)

(52) U.S. Cl.
CPC ..... *B65D 25/00* (2013.01); *B65D 65/22* (2013.01); *B65D 75/14* (2013.01);
(Continued)

(58) Field of Classification Search
CPC ..... B65D 75/68; B65D 75/66; B65D 5/542; B65D 75/28; B65D 75/5827; B65D 2571/0058; B65B 61/182; B65B 25/10; B65B 11/00
USPC ..... 220/270, 47, 450, 53; 206/605, 606, 206/600, 616, 551; 53/133; 426/122, 123; 229/87.05, 242, 243, 51; 383/200, 205
See application file for complete search history.

(56) References Cited

U.S. PATENT DOCUMENTS 4,801,075 A * 1/1989 Weber et al. ..... 229/87.05
5,024,331 A 6/1991 Litzler
(Continued)

FOREIGN PATENT DOCUMENTS

FR 2362765 A1 3/1978
FR 2662147 A1 11/1991
(Continued)

OTHER PUBLICATIONS

U.S. Patent and Trademark Office, Office Action issued in U.S. Appl. No. 13/131,517, mailed Jan. 9, 2013, 13 pp.
(Continued)

*Primary Examiner* — Shawn M Braden
(74) *Attorney, Agent, or Firm* — Wood, Herron & Evans, LLP

(57) ABSTRACT

A packaging material 1 is configured to pack a viscous product having one surface, an opposite surface, and side surfaces. The packaging material 1 includes a sheet 2 having a first surface portion 7 configured to cover the one surface of the viscous product, side surface portions 8-1 to 8-4 configured to cover the side surfaces, and second surface portions 9-1 to 9-4 disposed at the opposite surface, and tear tape 3 adhered to the sheet to cut the sheet. The tear tape is provided to start from the side surface portion or the second surface portion and to be branched into a first branched tape 3*a* and a second branched tape 3*b* across the first surface portion. The first branched tape is provided to pass through an edge of one side part of the first surface portion, and the second branched tape is provided to pass through an inner part of its width to form a grip 23 at the other side of the first surface portion, and continuously, to arrive at the other end of the first surface portion through an edge of the other side part of the first surface portion.

9 Claims, 7 Drawing Sheets

(51) Int. Cl.

| | |
|---|---|
| ***B65D 17/34*** | (2006.01) |
| ***B65D 25/00*** | (2006.01) |
| ***B65D 65/22*** | (2006.01) |
| ***B65D 75/14*** | (2006.01) |
| ***B65D 75/66*** | (2006.01) |
| ***B65D 85/76*** | (2006.01) |

(52) U.S. Cl.
CPC ..... *B65D 75/5838* (2013.01); *B65D 75/66* (2013.01); *B65D 85/76* (2013.01); *B65D 2575/3254* (2013.01); *Y10T 428/15* (2015.01)

(56) References Cited

U.S. PATENT DOCUMENTS

| | | | | |
|---|---|---|---|---|
| 7,414,230 | B2 | 8/2008 | Fitzwater | |
| 2006/0275531 | A1* | 12/2006 | Dal | 426/130 |
| 2008/0276569 | A1 | 11/2008 | Dal et al. | |

FOREIGN PATENT DOCUMENTS

| | | | |
|---|---|---|---|
| JP | 62168869 | | 7/1987 |
| JP | 01026623 | | 8/1989 |
| JP | 2006508868 | | 3/2006 |
| WO | 2006090227 | A1 | 8/2006 |

OTHER PUBLICATIONS

European Patent Office, Search Report issued in Application No. 09830188.0, mailed Sep. 26, 2013, 5 pp.

Search Report and Written Opinion issued in PCT Application No. PCT/JP2009/006528, mailed Jan. 12, 2010.

* cited by examiner

PACKAGING MATERIAL AND PACKED PRODUCT IN WHICH VISCOUS PRODUCT IS PACKED BY PACKAGING MATERIAL

TECHNICAL FIELD

The present invention relates to a packaging material appropriate to pack a viscous product which may enter a fluidic state and a packed product in which the viscous product is packed by the packaging material.

This application claims priority to and the benefits of Japanese Patent Application No. 2008-307285 filed on Dec. 2, 2008, the disclosure of which is incorporated herein by reference.

BACKGROUND ART

In recent years, as a packaging material configured to pack a viscous product such as cheese portion having a small block shape, which may enter a fluidic state, a set of a sheet material having tear tape (tear strip) attached thereto has been widely used. The packaging material is configured such that, in a state in which the viscous product is packed, when the tear tape is pulled, the sheet material is torn to expose the viscous product to the outside.

Such kinds of packaging materials, for example, are provided in the following patent documents 1 to 3.

[Patent Document 1] Published Japanese translation of a PCT application, No. 2006-508868

[Patent Document 2] Japanese Utility Model Publication No. H01-26623

[Patent Document 3] Japanese Patent Application, First Publication No. S62-168869

DISCLOSURE OF INVENTION

Technical Problem

The packaging materials disclosed in Patent Documents 1 to 3 are configured such that, in a state in which any one viscous product is packed, when the tear tape attached to the sheet material is pulled, the entire region including at least one surface of the viscous product is exposed to the outside according to a position of the tear tape. For this reason, when the viscous product is ingested in a state in which the viscous product is exposed, the exposed portion of the viscous product may be in direct contact with fingers or fingernails, and some consumers may complain about concerns of uncleanness of their fingers.

In addition, the packaging material disclosed in Patent Document 2 is configured such that a viscous product having a rectangular parallelopiped shape is entirely covered by a tear tape-adhered sheet material, and a center portion of the sheet material in a direction of the width of the viscous product is torn by pulling the tear tape. While the packaging material can secure a portion of the sheet material that can be gripped by fingers when the viscous product is exposed from the sheet material, a large region of the viscous product is covered by the sheet material. For this reason, since the sheet material must be further torn with fingers to remove the sheet material, the fingers or fingernails may directly contact the viscous product, and some consumers may complain about the product's clinging to their fingers.

In consideration of the above circumstances, it is an object of the present invention to provide a packaging material capable of being sanitarily torn by forming a grip in the packaging material to secure sufficient exposure of a viscous product to the outside, and a packed product packed by the packaging material.

Technical Solution

In order to solve the problems, the present invention provides the following aspects.

According to a first aspect of the present invention, there is provided a packaging material configured to pack a viscous product having one surface, an opposite surface, and side surfaces surrounding a periphery between the respective surfaces, the packaging material including: a sheet including a first surface portion configured to cover the one surface of the viscous product, a side surface portion configured to cover each of the side surfaces, and a second surface portion disposed at the other surface; and tear tape adhered to the sheet such that an end thereof is pulled to cut the sheet. The tear tape is provided to start from the side surface portion or the second surface portion and to be branched into a first branched tape and a second branched tape at the first surface portion, the first branched tape is provided to pass through an edge of one side part of the first surface portion, and the second branched tape is provided to pass through an inner part of its width to form a grip having a sufficient space at the other side part of the first surface portion, and continuously, to arrive at the other end of the first surface portion through an edge of the other side part of the first surface portion respectively.

According to a second aspect of the present invention, the second branched tape may be formed to pass through the middle of the width of the first surface portion.

According to a third aspect of the present invention, the first surface portion may have a rectangular shape to correspond to a shape of the one surface of the viscous product. In addition, the first branched tape of the tear tape may be extend from the middle of the width of the one end of the first surface portion toward the other end of the first surface portion, and bent to arrive at the edge of the other side part and further to arrive at the other end of the first surface portion.

According to a fourth aspect of the present invention, the first surface portion may have a triangular shape to correspond to a shape of the one surface of the viscous product, the tear tape may be branched from an apex of the triangular shape of the first surface portion, the first branched tape may be provided to pass through the edge of the one side part of the first surface portion, and the second branched tape may be formed to pass through the middle of the first surface portion and then pass through the edge of the other side part of the first surface portion.

According to a fifth aspect of the present invention, the first surface portion may have a triangular shape to correspond to a shape of the one surface of the viscous product, and the tear tape may be branched into the first branched tape and the second branched tape at the edge of the one side part of the first surface portion, the first branched tape may be provided at the edge of the one side part, and the second branched tape may be provided toward the edge of the other side part and the vicinity of the other end of the first surface portion from the branch point thereof.

According to a sixth aspect of the present invention, a reference remark representing an opening procedure may be printed near the starting point of the tear tape and/or at a side part adjacent to the first branched tape of the tear tape.

According to a seventh aspect of the present invention, there is provided a packed product manufactured by packing a viscous product using the packaging material according to the present invention.

According to an eighth aspect of the present invention, a lid sheet may be disposed on an opposite surface side of the viscous product.

Advantageous Effects

According to a packaging material of the present invention, since tear tape is provided on a sheet material in a certain disposition, when the tear tape is pulled to tear the sheet material from the viscous product, the sheet material can be sufficiently torn from the viscous product.

In addition, even when the sheet material is sufficiently torn, since a sufficient space for grip is remained, it is possible to prevent a finger and so on from contacting the viscous product. For this reason, a packed product using the packaging material is also favored by some consumers who have concerns of uncleanness of their fingers.

BEST MODE FOR CARRYING OUT THE INVENTION

Hereinafter, embodiments of the present invention will be described with reference to the accompanying drawings.

Figure 1:
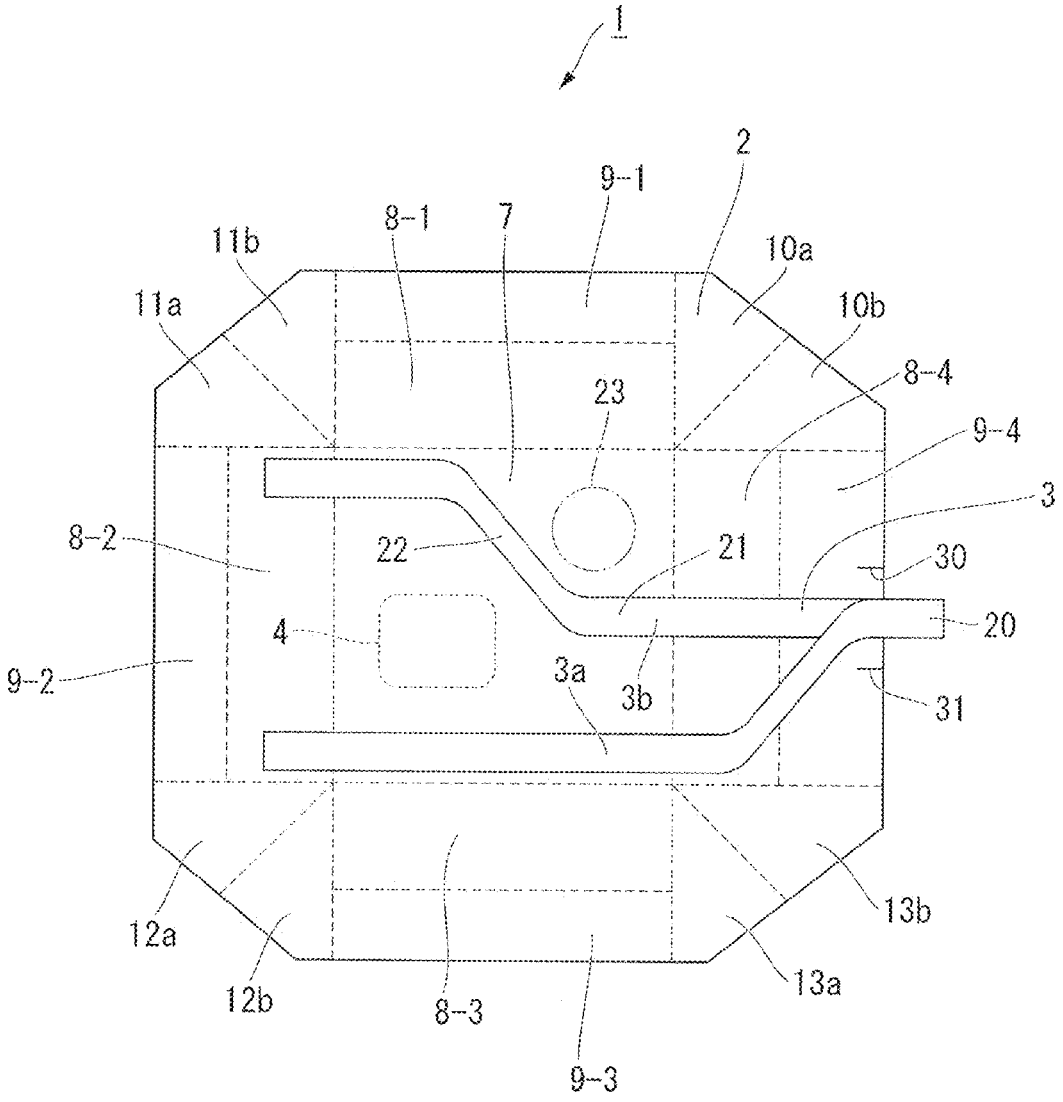
FIG. 1 shows a development of a packaging material in accordance with a first embodiment of the present invention when seen from inside.
Figure 2A:
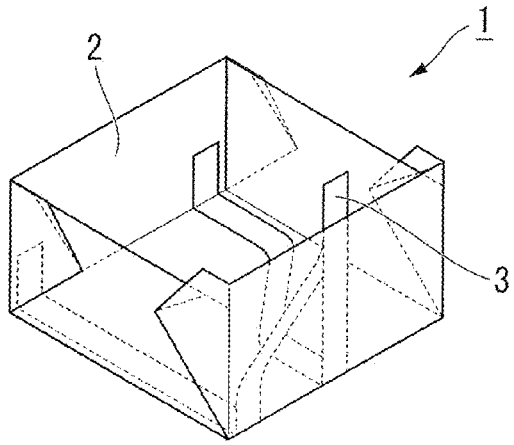
FIG. 2A is a view showing a manufacturing method when a packed product is manufactured using a packaging material of the present invention.
Figure 2B:
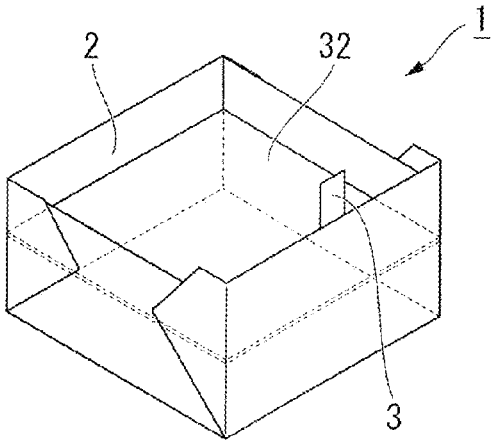
FIG. 2B is a view showing the manufacturing method when the packed product is manufactured using the packaging material of the present invention.
Figure 2C:
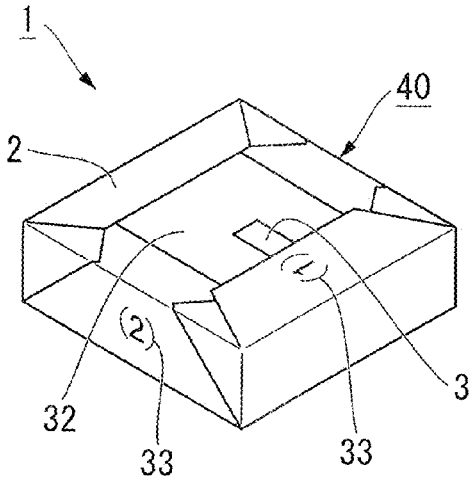
FIG. 2C is a view showing the manufacturing method when the packed product is manufactured using the packaging material of the present invention.
Figure 3:
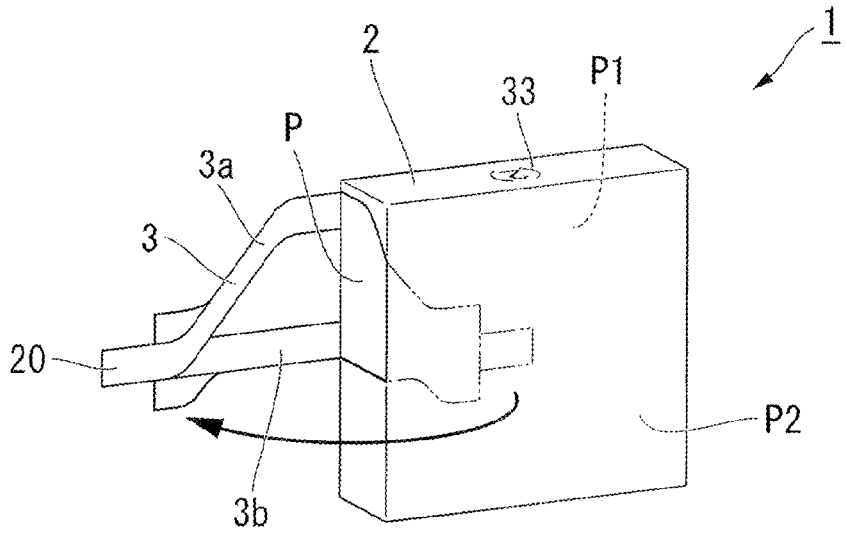
FIG. 3 is a view for explaining a case of tearing the packaging material from the packed product of the present invention.
Figure 4:
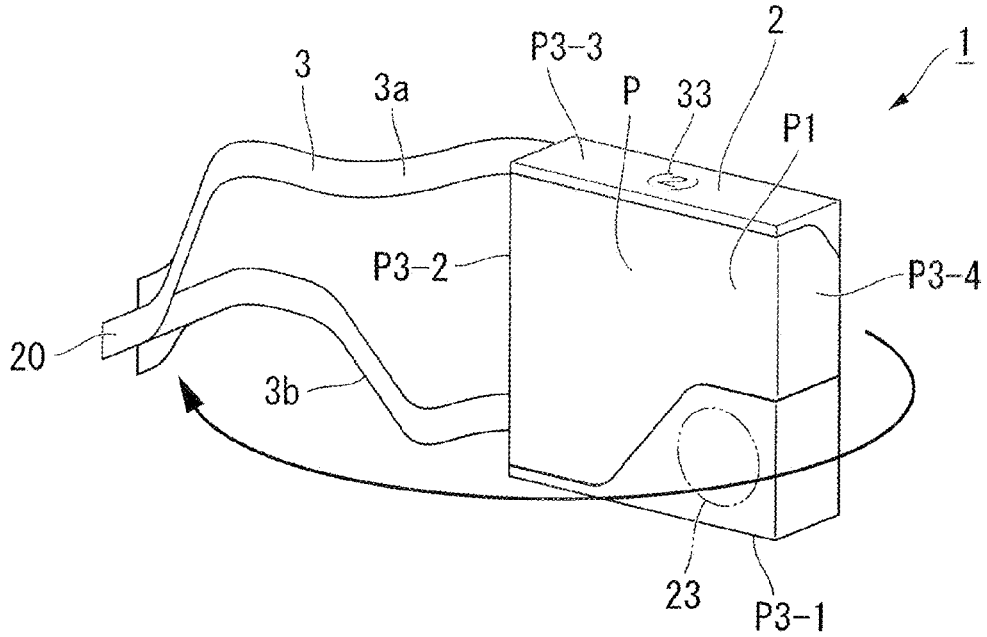
FIG. 4 is a view for explaining the case of tearing the packaging material from the packed product of the present invention.
Figure 5:
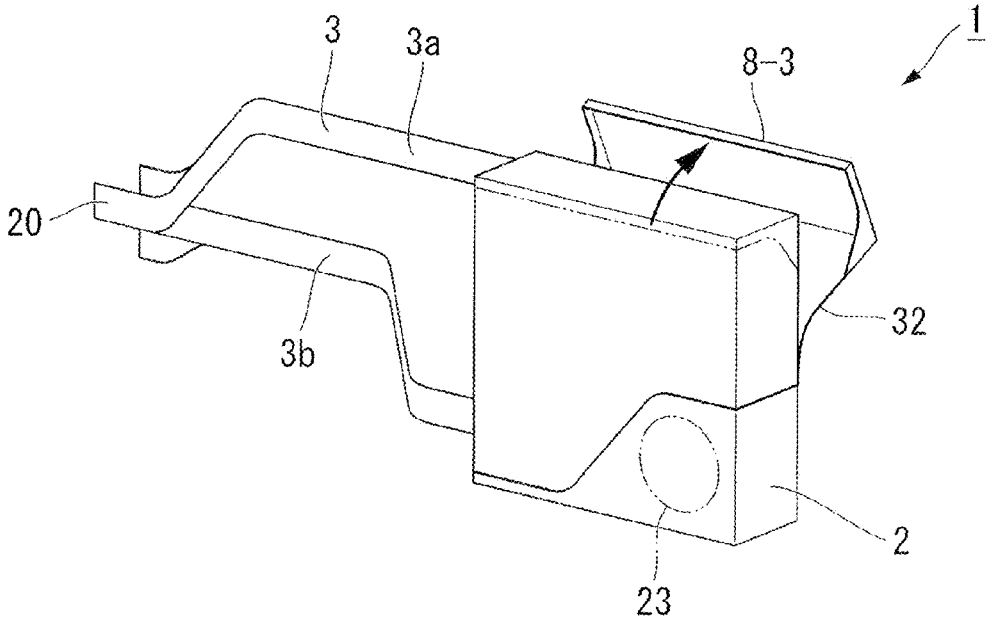
FIG. 5 is a view for explaining the case of tearing the packaging material from the packed product of the present invention.

FIGS. 1 to 5 are views showing a packaging material in accordance with a first embodiment of the present invention and a packed product in which a viscous product P is packed by the packaging material. FIG. 1 shows a development of the packaging material when seen from inside, FIGS. 2A to 2C show a manufacturing method when the packed product is manufactured by the packaging material, and FIGS. 3 to 5 are views for explaining a case of tearing off the packaging material from the packed product.

First Embodiment

As shown in FIG. 1, a packaging material 1 includes a sheet material 2 and tear tape 3 attached to the sheet material 2. The sheet material 2 includes a print 4 such as various marks and so on arranged at an outer surface side of an aluminum foil and an adhesive applied to an inner surface side thereof. In addition, in FIG. 1, while the print is shown to be formed on only a part of a first surface portion 7, the print 4 may be arranged on the entire surface of the first surface portion 7 or may be selectively arranged on an appropriate place.

Coating of the adhesive includes uniformly spreading a thermo-plastic polymer on an inner surface side of the aluminum foil, and as described later, it melts by heat to stick the sheet material 2 to a lid sheet as it cools.

The tear tape 3 is made of polyethylene terephthalate and having a strip shape and a small width, and the adhesive is coated on one surface thereof. The tear tape 3 is adhered to an inner surface of the sheet material 2 by melting the adhesive.

The viscous product P described in the embodiment may be, into a fluidic state in some condition such as a cream cheese and so on, and as shown in FIGS. 3 to 5, have a certain thickness to form a rectangular parallelopiped shape having a four-square shaped front surface. That is, the viscous product P has one surface P1, an opposite surface P2, and side surfaces P3-1 to P3-4 neighboring both of the surfaces.

As shown in FIG. 1, the sheet material 2 has an octagonal profile. In order to pack the viscous product P, the sheet material 2 includes a first surface portion 7 configured to cover the one surface P1 of the viscous product P, side surface portions 8-1 to 8-4 configured to cover the side surfaces P3-1 to P3-4 of the viscous product P, second surface portions 9-1 to 9-4 disposed at the opposite surface P2 of the viscous product P, and folds 10*a*, 10*b* to 13*a*, and 13*b* disposed neighboring the side surface portions 8-1 to 8-4 and the second surface portions 9-1 to 9-4. In addition, notches 30 and 31 are formed at both sides of the second surface portion 9-4 of the tear tape 3. Further, the notches 30 and 31 are not essential but may be preferably provided.

As described later, the respective parts are used to be folded to abut the respective surfaces of the viscous product P and surround the viscous product P. Lines shown as dotted lines in the drawing are folding lines.

One end of the tear tape 3 is provided in the middle of a width of the second surface portion 9-4 to project outward to some extent. The tear tape 3 is provided to start from a projection part 20 and go through the side surface portion 8-4 and the first surface portion 7 to the side surface portion 8-2.

In this case, the tear tape 3 is branched into a first branched tape 3*a* and a second branched tape 3*b* in the second surface portion 9-4.

The first branched tape 3*a* is provided to arrive at an edge of one side part in a width direction of the side surface portion 8-4 from the second surface portion 9-4, extend an edge of one side part of the first surface portion 7 from the edge of one side part in a straight shape to arrive at the other end of the first surface portion 7, and arrive at the middle of the side surface portion 8-2.

The second branched tape 3*b* is provided to arrive at the middle of the width of one end of the first surface portion 7 through the middle of the side surface portion 8-4 from the middle in a width direction of the second surface portion 9-4, extend from the one end toward the other end by a certain length, bend to the other side part of the first surface portion 7, gradually approach the same side part to arrive at an edge of the side part, further extend from the same edge to arrive at the other end of the first surface portion 7, and arrive at the middle of the side surface portion 8-2. In this configuration, "the width direction" means a widthwise direction (a vertical direction in FIG. 1) while a direction which the tear tape is pulled to cut the sheet material 2 in is considered a lengthwise direction (a lateral direction in FIG. 1).

Further, a grip 23 having a sufficient space to be gripped by fingers is formed in a portion surrounded by a straight part 21 and an arm part 22 of the second branched tape 3*b* on the first surface portion 7.

In this embodiment, when the viscous product P is packed, in addition to the packaging material 1, a lid sheet 32 shown in FIG. 2B is used.

The lid sheet 32 is formed of an aluminum foil and has a rectangular shape, and the above-described adhesive is applied to an outer surface side thereof and surface protection is applied to an inner surface side thereof.

Hereinafter, a method of packing the viscous product P using the packaging material 1 and the lid sheet 32 having the above configuration will be described.

The packing method described below includes folding the packaging material 1 into a predetermined shape, pouring, for example, cream cheese and so on in a melted state into the folded packaging material, and sealing the packaging material using heat of the product and heat and pressure by a seal head for packing, thereby manufacturing a packed product together with the packing.

Hereinafter, the packing method will be described in detail with reference to FIG. 2A to 2C. First, the packaging material 1 shown in FIG. 1 is folded into a box shape with an upper part open as shown in FIG. 2A. In this case, the packaging material 1 is bent such that the inner surface side of the sheet material 2 becomes an inside of the box.

When the packaging material 1 is bent, the folds 10*a*, 10*b* to 13*a*, and 13*b* are folded such that the first surface portion 7 becomes a bottom surface and the side surface portions 8-1 to 8-4 and the second surface portions 9-1 to 9-4 stand up to become side walls, forming the shape shown in FIG. 2A.

Next, as shown in FIG. 2B, the melted product (cream cheese and so on) is poured in the packaging material. At this time, the filling is stopped when the product arrives at upper ends of the side surface portions 8-1 to 8-4 of the packaging material 1. Next, the rectangular lid sheet 32 is put covering on a top of the product. A surface of the lid sheet 32 on which an adhesive is applied is directed upward.

In addition, as shown in FIG. 2C, together with the folds 10*a*, 10*b* to 13*a*, and 13*b*, first, the second surface portions 9-1 and 9-3 are bent toward the upper side of the product, the second surface portion 9-2 is bent into the same shape, and the second surface portion 9-4 is further bent, entirely forming a rectangular parallelopiped shape. The second surface portions 9-1 to 9-4 are folded toward the surface of the product, and the folds 10*a*, 10*b* to 13*a*, and 13*b* are further folded, entirely forming the rectangular parallelopiped shape. Next, the seal head passes the packaging material from outside.

At this time, the adhesive is applied on the inner surface of the sheet material 2, and the adhesive is also applied on an outer surface of the lid sheet 32. For this reason, the adhesive is melted by the heat of the product and the heat and pressure of the seal head, and as a temperature is lowered, the sheet material 2 is adhered to the lid sheet 32. As a result, the packing by the packaging material 1 is finished, and the packed product 40 having the viscous product P formed of a solidified product is completed.

Further, as shown in FIG. 2C, a reference mark 33 (a number (1)) representing an opening procedure is printed near a starting point of the tear tape 3. In addition, a reference mark 33 (a number (2)) representing an opening procedure is printed at a side part adjacent to the first branched tape 3*a* of the tear tape 3. The reference marks 33 are partially shown in FIGS. 3 and 4, but are omitted in the other drawings. The reason for this is that the reference marks 33 printed on the surface of the sheet material 2, i.e., the surface opposite to a surface to which the tear tape 3 is adhered makes illustration of them complicated. While the reference marks 33 may be characters or figures in addition to numbers, the numbers may be most preferable because they are simple.

When the packaging material 1 of the packed product 40 manufactured as described above is torn and the viscous product P is eaten, as shown in FIGS. 3 to 5, the packed product 40 is held by fingers of one hand, the end part 20 of the tear tape 3 is pulled by fingers of the other hand, and the tear tape 3 goes along tearing the side surface portion of the sheet material 2 (see FIG. 3).

In this case, since the notches 30 and 31 are formed in the second surface portion 9-4 of the sheet material 2, the sheet material 2 can be easily cut.

When the packed product 40 is held, the grip 23 of the packaging material 1 and an opposite surface corresponding to the grip 23 are pinched by the fingers of one hand holding the packed product 40.

Next, as shown in FIG. 4, the tear tape 3 is further pulled toward the first surface portion 7 and further pulled toward the side surface portion 8-2.

When the tear tape 3 is torn, the sheet material 2 between the first branched tape 3*a* and the second branched tape 3*b* is entirely torn from the viscous product P. In addition, since the first branched tape 3*a* and the second branched tape 3*b* are located on the side surface portion 8-4 and the first surface portion 7, such parts are also torn. Further, the second branched tape 3*b* tears the sheet material 2 with the grip 23 is remained.

Next, when the sheet material 2 is torn by the first branched tape 3*a* as described above, the side surface portion 8-3 and the lid sheet 32 can be easily pealed by the fingers as shown in FIG. 5.

In this state, the sheet material 2 and the tear tape 3 can be torn off, leaving the grip 23 held by the fingers. In addition, when the sheet material 2 and the tear tape 3 are torn off, almost all of the viscous product P except the gripped part is exposed to the outside. As a result, the viscous product P can be easily eaten.

According to the packaging material 1, since the tear tape 3 is disposed on the sheet material 2 in a certain arrangement as described above, when the tear tape 3 is pulled to tear the sheet material 2 from the viscous product P, the sheet material 2 can be sufficiently pealed from the viscous product P.

In addition, even when the sheet material 2 is sufficiently torn, since the grip 23 is remained, the viscous product P is not in contact with the fingers, and thus, it is possible to prevent clinging to the fingers.

Hereinafter, a second embodiment of the present invention will be described with reference to FIG. 6.

Second Embodiment

Figure 6:
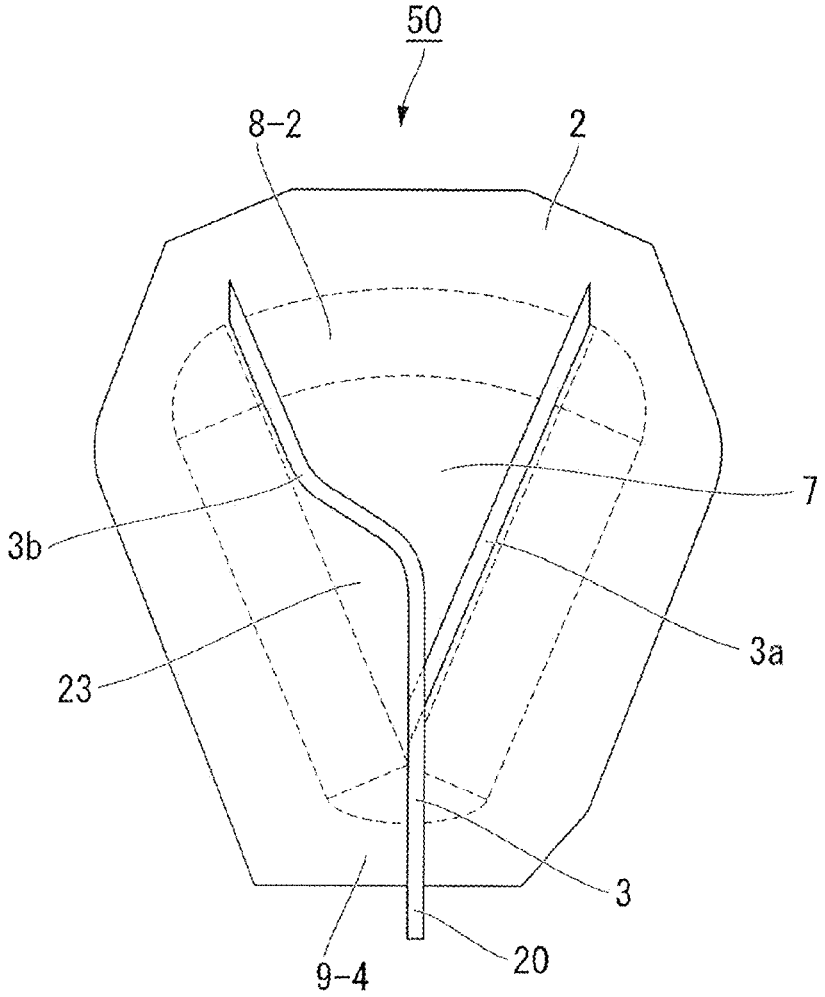
FIG. 6 shows a development of a packaging material in accordance with a second embodiment of the present invention when seen from inside.

In FIG. 6, like reference numerals refer to like elements in the first embodiment, and detailed description thereof will not be repeated.

FIG. 6 shows a development of a packaging material. Similar to the first embodiment, a packaging material 50 shown in the drawing is configured by adhering tear tape 3 to a sheet material 2.

The second embodiment is distinguished from the first embodiment in that a viscous product to be packed has a certain thickness and a triangular outline of the top surface corresponding to a shape of the viscous product P.

As shown in FIG. 6, a first surface portion 7 of the sheet material 2 has a triangular shape to correspond to the outline of the top surface of the viscous product.

The tear tape 3 is provided to branch into a first branched tape 3*a* and a second branched tape 3*b* through the first surface portion 7 from an end part 20 projecting from an edge of a second surface portion 9-4 by a certain length, and arrive at a side surface portion 8-2.

In this case, a branch point of the first and second branched tapes 3*a* and 3*b* of the tear tape 3 is on an apex of a triangular top surface part. The first branched tape 3*a* is provided in a straight shape along one straight part, i.e., along an edge of one side part of the triangular shape. The second branched tape 3*b* is provided to pass through the middle of the first surface portion 7, bend, and pass through an edge of the other side part of the first surface portion 7, In this case, a grip 23 is formed at a side part of the second branched tape 3*b*.

The packaging material 1 is used to pack the viscous product P similar to the first embodiment. In the second embodiment, for the viscous product packed by the packaging material 50, the grip 23 and the opposite side are gripped by fingers and the tear tape 3 is pulled off, obtaining the same effect as the first embodiment.

Moreover, a third embodiment of the present invention will be described with referent to FIGS. 7 and 8.

Third Embodiment

Figure 7:
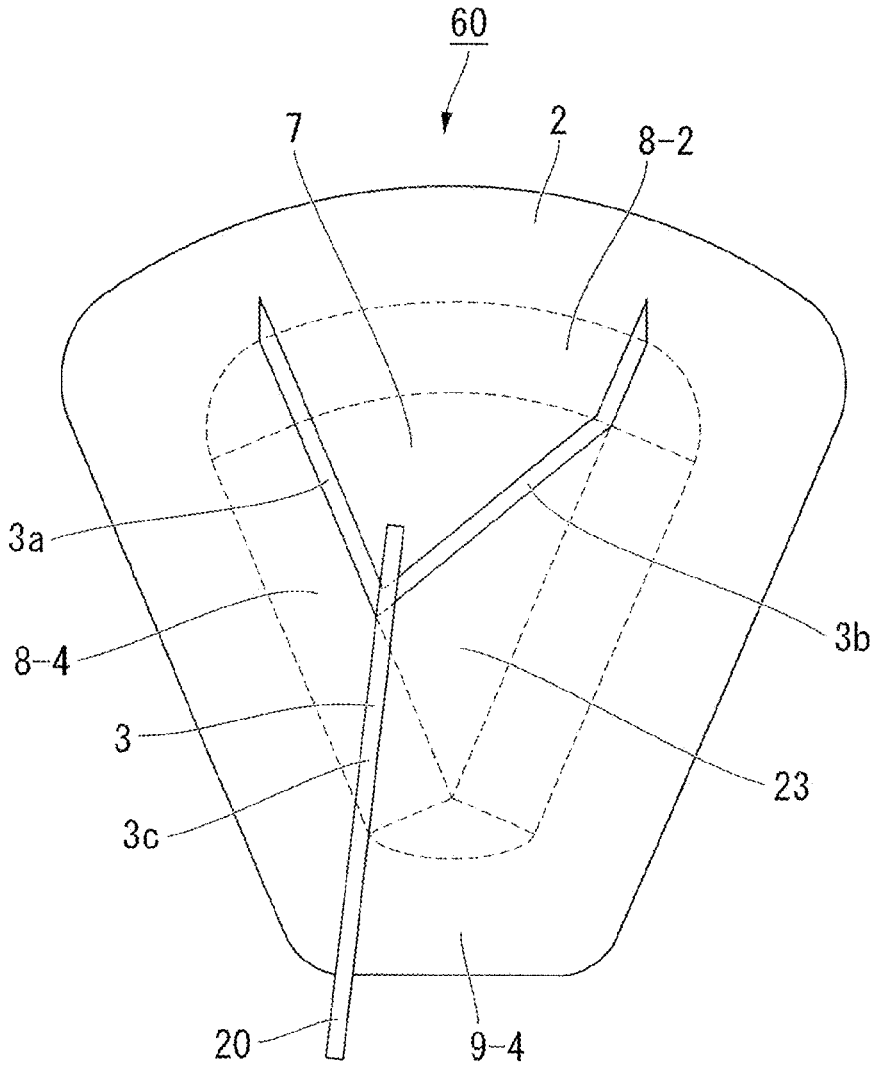
FIG. 7 shows a development of a packaging material in accordance with a third embodiment of the present invention when seen from inside.
Figure 8:
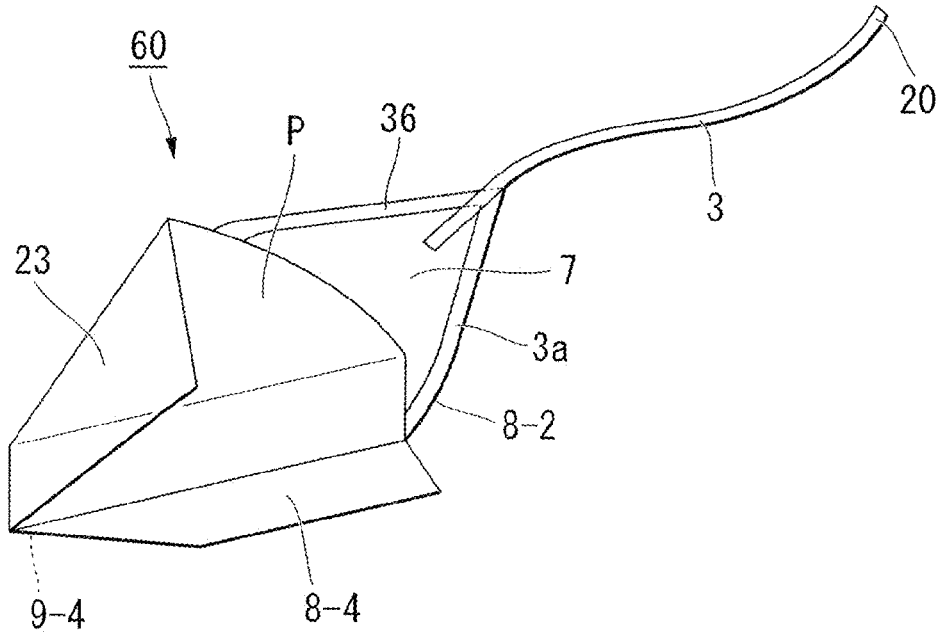
FIG. 8 is a schematic view showing a case of tearing the packaging material from a packed product in accordance with the third embodiment of the present invention.

In FIGS. 7 and 8, like reference numerals refer to like elements in the second embodiment, and detailed description thereof will not be repeated.

In the third embodiment, a packed product 60 has a triangular shape such that a first surface portion 7 corresponds to a surface shape of the viscous product. Tear tape 3 has a straight part 3*c* which includes an end part 20 passing through amide surface portion 8-4 from a second surface portion 9-4, and is branched into a first branched tape 3*a* and a second branched tape 3*b* in an edge of one side part of the first surface portion 7. In addition, the first branched tape 3*a* is provided in a straight shape at the edge of the one side part, and the second branched tape 3*b* is provided in a straight shape toward an edge of the other side of the first surface portion 7 and the vicinity of the other end of the first surface portion 7 from the branch point.

In the third embodiment, when the packaging material 60 is torn from the viscous product, as shown in FIG. 8, a grip 23 and an opposite surface are gripped by fingers, and the end part 20 of the tear tape 3 is pulled. As a result, since a region from the second surface portion 9-4 through the side surface portion 8-4 and the first surface portion 7 to the side surface portion 8-2 can be torn, and in a state in which the grip 23 is gripped, almost all of the packaging material except the grip 23 and the opposite surface can be torn off.

In the third embodiment, the same effect as the second embodiment can be obtained. In addition, since the straight part 3*c* of the tear tape 3 passes through the second surface portion 9-4 and the side surface portion 8-4 and is branched at the edge of the one side part of the first surface portion 7, an area of the grip 23 can be more widely obtained due to position of the tear tape 3 so that the packed product can be more stably held.

Further, in FIG. 7, while the straight part 3*c* is shown to be branched in the edge of the one side part of the first surface portion 7, the branch point may be located at a nearer part from the end part of the straight part 3*c*, i.e., the side surface portion 8-4.

In addition, the following configuration may be applied to the second embodiment.

That is, while in the second embodiment, the tear tape 3 has a substantial V-shape at the first and second branched tapes and tips of the V-shape are formed in one straight-shaped portion, two straight-shaped tear tapes 3 may cross each other to forma V-shape, and when the viscous product is packed, the two tear tape 3 portions at a V-shape forming side and an opposite side may overlap each other as one to become an end of the tear tape 3.

In this configuration, ends of the two overlapped tear tapes 3 are gripped to tear the packaging material 1.

This invention can be applied to such a packaging material and packed product.

In addition, a width of the tear tape 3 need not be uniform, and the width may be appropriately varied depending on a strength required for the tear tape 3 or circumstances when the tear tape 3 is manufactured.

INDUSTRIAL APPLICABILITY

As described above, according to the present invention, it is possible to provide a packaging material that are capable of sufficiently exposing a viscous product to the outside when a sheet packing the viscous product is cut, and being sanitarily and easily torn by forming a grip in the packaging material, and a packed product packed by the packaging material.

DESCRIPTION OF REFERENCE NUMERALS

1; Packaging material 2: Sheet 3: Tear tape 3*a*: First branched tape 3*b*: Second branched tape 7; First surface portion 8-1 to 8-4: Side surface portions 9-1 to 9-4: Second surface portions 23: Grip 32: Lid sheet 40, 50, 60: Packed product

The invention claimed is:

1. A packaging material configured to pack a viscous product having one surface, an opposite surface, and side surfaces, the packaging material comprising:

a sheet including a first surface portion configured to cover the one surface of the viscous product, side surface portions configured to cover the side surfaces, and a second surface portion disposed at the opposite surface; and tear tape adhered to the sheet such that an end thereof is pulled to cut the sheet, wherein the tear tape is provided to start from the side surface portion or the second surface portion and to be branched into a first branched tape and a second branched tape at the first surface portion, the first branched tape is provided to pass through an edge of one side part of the first surface portion, and the second branched tape is provided to pass through a middle of the width of the first surface portion to form a grip having a sufficient space at an other side part of the first surface portion, and continuously, to arrive at an other end of the first surface portion through an edge of the other side part of the first surface portion respectively.

2. The packaging material according to claim 1, wherein the first surface portion has a rectangular shape to correspond to a shape of the one surface of the viscous product, and the second branched tape of the tear tape is provided to extend from a middle of the width of one end of the first surface portion toward the other end of the first surface portion, bend to arrive at the edge of the other side part of the first surface portion, and further to arrive at the other end of the first surface portion.

3. The packaging material according to claim 1, wherein the first surface portion has a triangular shape to correspond to a shape of the one surface of the viscous product, the tear tape is branched from an apex of the triangular shape of the first surface portion, the first branched tape is provided to pass through the edge of the one side part of the first surface portion, and the second branched tape is formed to pass through the middle of the first surface portion and then pass through the edge of the other side part of the first surface portion.

4. The packaging material according to claim 1, wherein the first surface portion has a triangular shape to correspond to a shape of the one surface of the viscous product, and the tear tape is branched into the first branched tape and the second branched tape at the edge of the one side part of the first surface portion, the first branched tape is provided at the edge of the one side part of the first surface portion, and the second branched tape is provided toward the edge of the other side part and the vicinity of the other end of the first surface portion from the branch point thereof.

5. The packaging material according to any one of claims 1, 2 to 4, wherein a reference remark representing an opening procedure is printed near the starting point of the tear tape and/or a side part adjacent to the first branched tape of the tear tape.

6. A packed product manufactured by packing a viscous product using the packaging material according to any one of claims 1, 2 to 4.

7. A packed product manufactured by packing a viscous product using the packaging material according to claim 5.

8. The packed product according to claim 6, wherein a lid sheet is disposed on an opposite surface side of the viscous product.

9. The packed product according to claim 7, wherein a lid sheet is disposed on an opposite surface side of the viscous product.

* * * * *